US006179963B1

(12) United States Patent
Begemann et al.

(10) Patent No.: US 6,179,963 B1
(45) **Date of Patent: *Jan. 30, 2001**

(54) PROCESS FOR INFLUENCING THE BREAKING LENGTH CROSS-MACHINE PROFILE OF A RUNNING FIBROUS MATERIAL WEB

(75) Inventors: Ulrich Begemann; Adolf Guggemos, both of Heidenheim (DE)

(73) Assignee: Voith Sulzer Papiermaschinen GmbH (DE)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/746,918

(22) Filed: Nov. 18, 1996

(30) Foreign Application Priority Data

Nov. 17, 1995 (DE) ..... 195 12 873

(51) Int. Cl.[7] ..... D21H 15/00

(52) U.S. Cl. ..... 162/188; 162/109; 162/199; 162/202; 162/216; 162/DIG. 11

(58) Field of Search ..... 162/101, 109, 162/202, 216, 336, 259, 149, 100, 131, 353, 188, DIG. 11, 212

(56) References Cited

U.S. PATENT DOCUMENTS

| | | | | |
|---|---|---|---|---|
| 3,837,999 | * | 9/1974 | Chung | 162/101 |
| 4,888,094 | | 12/1989 | Weisshuhn et al. | 162/198 |
| 4,897,158 | | 1/1990 | Weisshuhn et al. | 162/259 |
| 4,898,643 | | 2/1990 | Weisshuhn et al. | 162/259 |
| 5,022,965 | | 6/1991 | Pitkäjärvi | 162/192 |
| 5,196,091 | | 3/1993 | Hergert | 162/258 |
| 5,674,364 | * | 10/1997 | Pitkajarvi | 162/216 |

FOREIGN PATENT DOCUMENTS

| | | |
|---|---|---|
| 3514554 | 3/1986 | (DE) . |
| 3538466 | 5/1988 | (DE) . |
| 475671 | 9/1991 | (EP) . |
| 774540 | 11/1996 | (EP) . |
| 89 11561 | 11/1989 | (WO) . |

OTHER PUBLICATIONS

Hans Dahl et al; *The influence of headbox flow conditions on paper properties and their constancy*; 1988; pp. 93–98.

Heinzmann, H., "Faserorientierungs–Querprofil", *Wochenblatt für Papierfabrikation*, 1995, H. 4, pp. 121–126.

Heinzmann, H., Offprint of Voith Sulzer Papiertechnik, "Faserorientierungs–Querprofil", Wochenblatt für Papierfabrikation 4, 1995, entire brochure.

Egelhof, D., "Der Einfluβ des Stoffauflaufes auf Asymmetriefehler im Papier", *Das Papier*, H. 7, 1986, pp. 313–318.

Htun, M., "The In–Plane Anisotrophy of Paper in Relation to Fiber Orientation and Drying Restraint", BRISTOW, Marcel Dekker Inc. New York, 1986, pp. 328–333.

Mark, R., "Structure and Structure Anisotrophy", *Handbook of Physical and Mechanical Testing of Paper and Paperboard*, Marcel Dekker, Inc., New York, 1983, pp. 283–287.

Opherden, et al., "Zellstoff Papier", 1979, VEB Fachbuchverlag Leipzig, pp. 403–417.

Blechschmidt, et al., "Begriffe der Blattbildung", *Wochenblatt für Papierfabrikation*, 3, 1994, pp. 76–77.

Bauer, W. et al., "Über die Messung der Faserorientierung in einem Papierblatt mittels Laserstrahlung", *Wochenblatt für Papierfabrikation*, 11/12, 1988, pp. 461–468.

Gräser, A., "Querprofilregelung–Regelstrategien", *Wochenblatt für Papierfabrikation*, 8, 1995, pp. 352–360.

Paetow, R., et al., "Querkontraktionazahl von Papier", *Das Papier*, H 6, 1990, pp. 229–236.

Reinwert, K–D, "Der Laserdruck—ein neuer Anspruch an den Papiermacher", *Das Papier*, H. 7, 1990, pp. 364–369.

Syré, H.R., "Messung von kontinuierlichen Profilen der Faserorientierung mittels Laserstrahlung", *Das Papier*, H. 3, 1988, pp. 109–116.

A. Kohl, "Messung Physikalischer Kenngroβen an iaufenden Bahnen", *Das Papier*, 1985, H. 10a, pp. 172–177.

* cited by examiner

*Primary Examiner*—Peter Chin
(74) *Attorney, Agent, or Firm*—Ostrolenk, Faber, Gerb & Soffen, LLP

(57) ABSTRACT

A process for producing a paper web having an essentially flat basis weight cross-machine profile and for simultaneously producing an essentially flat breaking length ratio cross-machine profile. This is achieved in that the lay of the fibers is deliberately influenced with a knowledge of shrinkage behavior. Techniques for respective sectional adjustments in the cross-machine direction are described.

10 Claims, 1 Drawing Sheet

PROCESS FOR INFLUENCING THE BREAKING LENGTH CROSS-MACHINE PROFILE OF A RUNNING FIBROUS MATERIAL WEB

BACKGROUND OF THE INVENTION

The invention relates to a process for influencing the breaking length cross-machine profile of a running fibrous material web in a paper machine by use of a consistency controlled flowbox which discharges the stock suspension onto a wire or between two wires.

Flowboxes of this type are known, for example from:

(1) DE 35 14 554 A1

(2) U.S. Pat. No. 5,196,091

(3) DE 40 19 593 C2

Essential quality features of paper webs are the uniformity of paper thickness, the strengths in the machine and cross-machine directions, the fiber orientation and the basis weight, in each case viewed across the web width. The basis weight profile is of decisive importance.

DE 40 19 593 C2 discloses measures to make the profiles of these properties largely uniform. The paper stock suspension is fed to the flow chamber of the flowbox through a plurality of channels which are located alongside one another in parallel and are distributed uniformly over the machine width. A mixer is connected upstream of each channel by which the concentration and the throughput in the channel may be set variably. This avoids need for adjusting spindles at the lips of the outlet channel of the flowbox. The lips are kept straight by their more or less stiff construction, so that the outlet gap between the lips has a constant height, viewed across the width in the gap. In other constructions, for example, U.S. Pat. No. 5,196,091, the outlet gap is also adjusted.

The breaking length represents a measure of the breaking strength of the paper. It indicates the length of the paper strip that will break under the load of its own weight.

A breaking length can be determined in the machine direction of the paper web or else in the cross-machine direction. The so-called breaking length ratio presents a particular problem. From this breaking length, it is possible to determine the ratio $R_L/R_Q$ (=breaking length ratio). Measurements have shown that the breaking length ratio, measured across the width of the paper web, is of variable size. In the central region across the web width, it is to a certain extent constant, whereas it decreases towards the edges. As a result, the breaking length ratio, represented over the width of the paper web, resembles the internal contour of a bathtub which is open upward or open downward.

A web having a large ratio of $R_L/R_Q$ is able to absorb pronounced tensile forces in the machine direction.

This is of particular interest during processing in fast running printing machines. In the latter, $R_L$ should therefore be large in relation to $R_Q$.

By contrast, in the case of so-called format papers, as well as for many packaging papers, a strength which, as far as possible, is equal in the machine direction and in the cross-machine direction is desired. If this is not present and if the cross-machine strength is low at the web edges, then tearing of the web occurs when it is loaded in the cross-machine direction.

SUMMARY OF THE INVENTION

The invention has the object of configuring the paper-making process to influence the cross-machine profiles of breaking length ratio and basis weight so that they primarily run linearly, in that the above-mentioned bathtub effect is suppressed to a large extent, and so that the profile of the breaking length ratio, viewed over the web width, becomes as linear as possible.

The inventors hereof knew that the breaking length ratio is directly correlated with the fiber alignment or fiber orientation in the paper web. But the fiber orientation is not solely responsible for the breaking length ratio. This fiber orientation can be measured off line and on line. The off line method is intended to be described below. For this, one takes various samples across the width of the web from a finished paper reel at the end of the paper machine. On these samples, one identifies the web running direction, the machine long sides (front side and drive side) and a measure X, of the distance of the sample from the left-hand edge, viewing the paper from above.

This off line measuring method gives a good overview of the fiber orientation of the paper weight currently being produced, since the production processes are sufficiently stationary with time.

In order to assess the fiber orientation, an imaginary coordinate system is placed onto the paper sample. In this case, the Y axis points in the web running direction and the X axis points correspondingly transversely to that direction. Irrespective of the measuring method used, the breaking length, for example, is determined as a function of the measuring angle (positive angle measured from the positive Y axis in the direction of the positive X axis and negative angle measured from the positive Y axis in the direction of the negative X axis). The representation of the measurement results, presented in the form of vectors having starting points located at the origin of the imaginary coordinate system, yields a semi-ellipse, having major axes which may not coincide with the coordinate axes. The orientation of the major axes has been defined in the web running direction or at right angles thereto in the clockwise direction.

It has become established practice to mirror the semi-ellipses symmetrically about a point and to represent them as complete ellipses, although this is not correct for the reason that a measured value at a specific angle alpha naturally yields the identical, only repeating itself, measured value at the angle alpha + or −180°. These ellipses are called fiber orientation ellipses below.

The ratio of the location vector in the Y direction to the location vector in the positive X direction then yields the so-called breaking length ratio. This value is dimensionless. The angle between the maximum location vector and the positive Y axis indicates the fiber orientation angle.

This property of the direction dependent strength value of the paper is called anisotropy. Quantitatively, it is expressed, for example, using the breaking length ratio.

In order to represent the properties of fiber orientation and strength properties across the machine width, that is, the cross-machine profile, one needs at least three diagrams (machine direction breaking length, cross-machine direction breaking length, fiber orientation angle or breaking length ratio, one breaking length, fiber orientation angle). These diagrams then depict the evidence of theoretically infinitely many fiber orientation ellipses.

The inventors hereof knew from practice that a paper web shrinks not only in the machine direction but also in the cross-machine direction during drying. Indeed, it shrinks particularly severely in the edge regions. The resulting cross-machine shrinkage profile likewise has a curve which is similar to the bathtub shape.

Although paper fibers shrink more severely transversely to their longitudinal extent than in their longitudinal direction during drying, the more severe cross-machine shrinkage effect at the edges of a paper web cannot be explained merely by a fiber orientation which is typical for the edge region.

Moreover, the inventors also knew that any measures for influencing fiber orientation and hence for influencing the breaking length ratio must not make the basis weight cross-machine profile worse.

The object of the invention is achieved by setting the web property cross-machine profile by the lay of the fibers such that the ratio of breaking length in the machine direction to the breaking length in the cross-machine direction is essentially constant over the width of the web.

The inventors have recognized that, in spite of the large number of parameters which have to be taken into account and some of which partially cause others, it is possible to set an essentially flat basis weight cross-machine profile and a breaking length ratio cross-machine profile at the same time.

Since the invention of consistency controlled flowboxes, a good basis weight cross-machine profile and a good fiber orientation cross-machine profile may be set at the same time.

If such a flowbox additionally has a sectionally adjustable aperture adjustable at respective cross-machine sections, this provides a further control element. Thus, for example, the effect of the increase in basis weight at the web edges, which is caused by more severe cross-machine shrinkage at the edges, can be compensated for. In parallel, however, further measures to influence the consistency and/or volume flow are then necessary in order to ensure good fiber orientation.

A uniform fiber orientation cross-machine profile does not mean, however, that the breaking length ratio cross-machine profile is simultaneously good.

In order to achieve a uniform breaking length ratio cross-machine profile, i.e., a reduction in the "bathtub edges", the inventors take into account changing of the cross-machine breaking length by means of the cross-machine shrinkage, in particular changing the cross-machine breaking length in the web edge region. The lay of the fibers over the web width is in this case deliberately set differently in the edge regions than in the central region.

The aids to accomplishing this are influencing the lay of the fibers by means of sectionally different (i.e. in the cross-machine direction) turbulence states, and/or aperture openings, and/or volume flows, consistencies, and/or by use of differential speeds between wire and stock jet and/or by sectionally different wall roughnesses.

By means of these measures, the wet expansion ratio cross-machine profile of the paper web may also optionally be set, since there is a dependence between the wet expansion behavior and the breaking length.

Objects and features of the invention are explained in more detail with reference to the accompanying drawings.

DESCRIPTION OF THE DRAWINGS $R_L$ is the breaking length of the web in the length direction. $R_Q$ is the breaking length of the web in the cross-machine direction.

Figure 1:
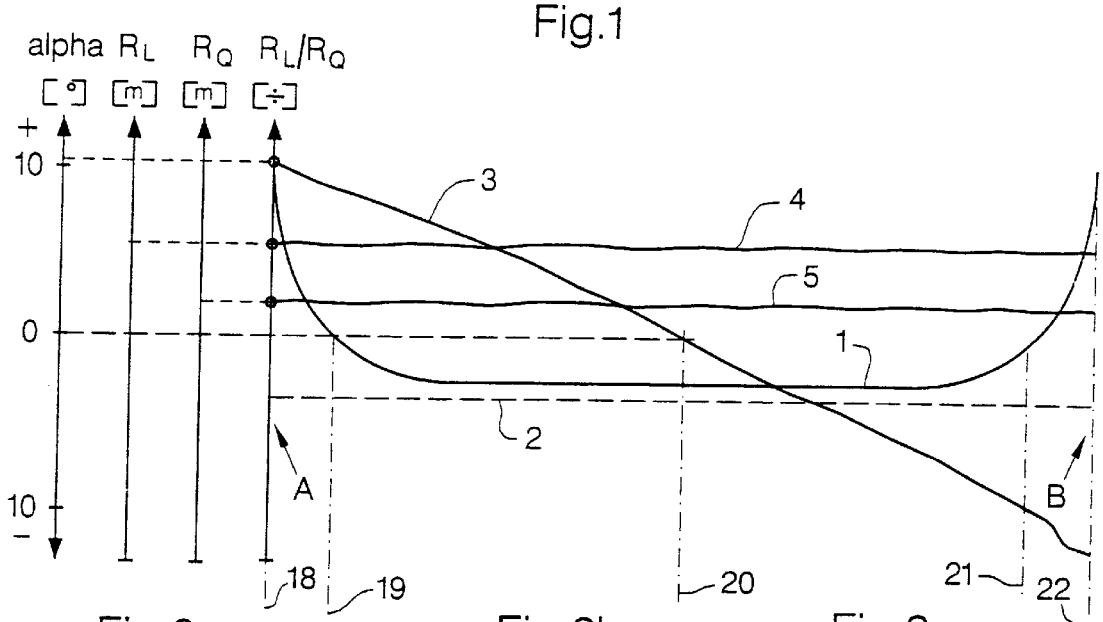
FIG. 1 shows a diagram to represent the breaking length ratio cross-machine profile of a paper web.
Figure 3A:
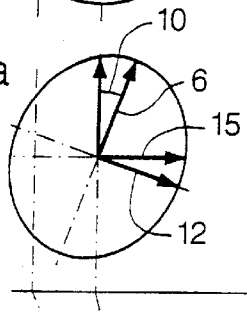
FIGS. 3*a* to *c* are representative fiber orientation ellipses of a paper web before drying, with a fiber orientation angle in some cases not equal to zero.
Figure 3B:
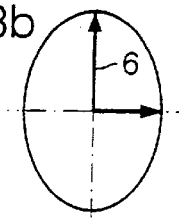
Figure 3C:
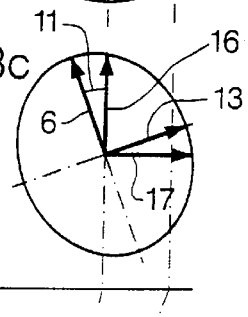

The curve 1 in FIG. 1 shows the breaking length ratio cross-machine profile $R_L/R_Q$ of a web in diagrammatic form, before the application of measures according to the invention. A and B indicate the respective web edges. The so-called "bathtub profile" is apparent. Graph line 2 shows an ideal breaking length ratio cross-machine profile following the application of the measures according to the invention. Graph line 3 represents the fiber orientation angle alpha over the width of a web, which as can be seen in FIGS. 3*a* to *c*, is representative of a specific fiber orientation cross-machine profile.

FIGS. 2*b*, 3*b*, 4*b* and 5*b* have been chosen for example such that their fiber orientation angle is zero. In practice, however, that angle may deviate slightly from this value in relation to the edge region of a web.

Instead of the exemplary ideal breaking length ratio cross-machine profile 2, this could alternatively be expressed by the graphs of the machine direction breaking length cross-machine profile $R_L$ 4 and of the cross-machine breaking length cross-machine profile $R_Q$ 5.

In FIGS. 2*a* to 5*c*, for reasons of visualization, the major axis 6 of the fiber orientation ellipses points more or less in the Y direction and has been represented for a sample length. The major axes located at right angles thereto in the clockwise direction have in some cases (likewise for reasons of visualization) different magnitudes.

Figure 2A:
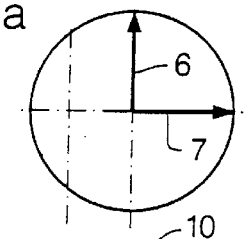
FIGS. 2*a* to *c* are representative fiber orientation ellipses of a paper web before drying, with a fiber orientation angle equal to zero.
Figure 2B:
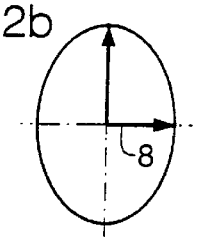
Figure 2C:
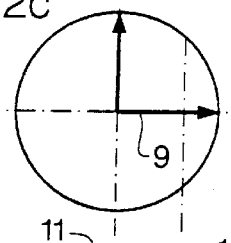

In FIGS. 2*a* to 2*c*, the major axis 6 and the major axes 7, 8, 9 coincide with the axes of the coordinate system. The major axes 6, 7, 8 and 9 thus at the same time embody the breaking lengths of these samples. The breaking length ratio is approximately one in the case of FIGS. 2*a* and 2*b*. For FIG. 2*b*, a positive value greater than one is obtained. The fiber orientation angle is in each case zero in the case of FIGS. 2*a* to *c*.

In FIGS. 3*a* and 3*c*, because of the fiber orientation angle 10 and 11, respectively, the major axes 6, 12 and 13 do not coincide with the breaking lengths 14, 15 and 16, 17. For FIG. 3*b*, the fiber orientation angle is zero and therefore the major axes coincide with the breaking lengths. FIGS. 3*a* to *c* represent the graphs 3 and 1 in FIG. 1.

Figure 4A:
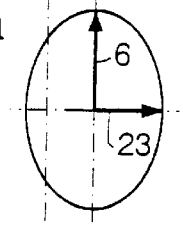
FIGS. 4*a* to *c* are representative fiber orientation ellipses of a paper web following drying, with a fiber orientation angle equal to zero.
Figure 4B:
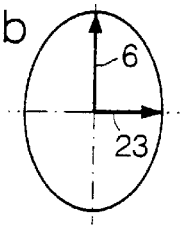
Figure 4C:
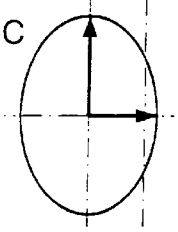

FIGS. 4*a* to *c* correspond to FIGS. 2*a* to *c* following the drying of the paper web. As can be read off at the auxiliary lines 18, 19, 21 and 22, the width of the web has shrunk in this case. Here, the auxiliary lines 18 and 22 show a more severe shrinkage in the outermost edge region than do the auxiliary lines 19 and 21 in the region located further toward the web center.

By means of the deliberate setting according to the invention of the lay of the fibers in the edge region of a web as a function of its shrinkage behavior, the cross-machine breaking length is set such that, for the fiber orientation ellipses in the edge region, the same breaking length ratio is produced as for the central web region. In other words: the major axis 7 has become a vector 23. In this case, the vector 23 essentially corresponds to the vector 8 since the shrinkage as a result of drying only has an insignificant effect in the web center.

Figure 5A:
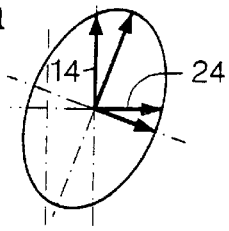
FIGS. 5*a* to *c* are representative fiber orientation ellipses of a paper web following drying, with a fiber orientation angle in some cases not equal to zero.
Figure 5B:
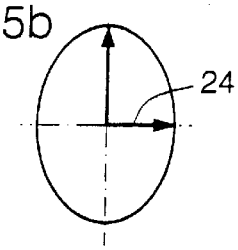
Figure 5C:
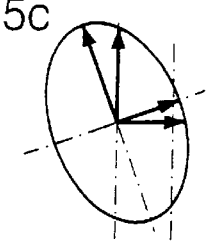

FIGS. 5*a* to *c* correspond to FIGS. 3*a* to *c* following the drying of the paper web. The same is true here as for FIGS. 3*a* to *c* and FIGS. 4*a* to *c*. The breaking length 24 of FIG. 5*b* corresponds to those of FIGS. 5*a* and *c*.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A process for producing a paper web comprising:

measuring in a section taken width-wise of the paper web respective breaking lengths in a machine direction and a cross-machine direction of the section of the paper web to obtain a measurement; and setting a lay of the fibers at the edges of the web based upon the measurement obtained to be different from a lay of fibers in another section other than the edges of the web in the cross-machine direction of the web to take into account changes in the breaking length due to cross-machine direction shrinkage of the web such that the ratio of a breaking length in the machine direction to a breaking length in the cross-machine direction is a desired ratio which is essentially constant from edge to edge over the cross-machine direction of the web.

2. The process of claim 1, wherein the lay of the fibers is set so that both the breaking length in the machine direction and the breaking length in the cross-machine direction are essentially constant.

3. The process of claim 1, wherein the paper web is wet when the web property cross-machine profile is set.

4. The process of claim 1, wherein the web property cross-machine profile is set based on the ratio of the breaking lengths after the paper web has reached its final dryness.

5. The process of claim 1, further comprising setting the lay of the fibers by setting respective, sectional, apertures in the flow box for the web stock across the width of the flow box.

6. The process of claim 1, further comprising setting the lay of the fibers by providing respective different sectional roughnesses of the flow guiding walls of the flow box across the machine direction.

7. The process of claim 1, further comprising setting the lay of the fibers by providing respective sectional volume flows in the flow box at respective sections across the flow box and in the cross-machine direction of the web.

8. The process of claim 1, further comprising setting the lay of the fibers by providing respective sectional consistencies in the flow box at respective sections across the flow box and in the cross-machine direction of the web.

9. The process of claim 1, further comprising setting the lay of the fibers by providing respective sectional speeds between the wire speed on which the web stock is flowed and the web stock flow from the flow box at respective sections across the flow box and in the cross-machine direction of the web.

10. The process of claim 1, wherein the lay of the fibers in the cross-machine direction are set at different orientations for maintaining the breaking length ratio constant.

* * * * *